US009732642B2

(12) United States Patent
Lee et al.

(10) Patent No.: US 9,732,642 B2
(45) Date of Patent: Aug. 15, 2017

(54) APPARATUS FOR RESETTING AN ENGINE BRAKE USING DECOMPRESSING

(71) Applicants: HYUNDAI MOTOR COMPANY, Seoul (KR); Kia Motors Corporation, Seoul (KR)

(72) Inventors: Gi-Ra Lee, Hwaseong-si (KR); Jung-Ho Kim, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 90 days.

(21) Appl. No.: 14/830,542

(22) Filed: Aug. 19, 2015

(65) Prior Publication Data

US 2016/0160711 A1 Jun. 9, 2016

(30) Foreign Application Priority Data

Dec. 9, 2014 (KR) ..... 10-2014-0175960

(51) Int. Cl.
*F01L 13/06* (2006.01)
*F02D 13/04* (2006.01)

(52) U.S. Cl.
CPC ..... *F01L 13/065* (2013.01); *F02D 13/04* (2013.01)

(58) Field of Classification Search
CPC ..... F01L 13/065; F02D 13/04
USPC ..... 123/321
See application file for complete search history.

(56) References Cited

U.S. PATENT DOCUMENTS 8,146,566 B2 * 4/2012 Lee ..... F01L 13/065 123/321
8,240,288 B2 8/2012 Dilly
2010/0307451 A1 * 12/2010 Lee ..... F02D 13/04 123/321
2014/0083381 A1 3/2014 Roberts et al.

FOREIGN PATENT DOCUMENTS

KR 10-2010-0132150 A 12/2010
KR 10-2011-0012873 A 2/2011
KR 10-2011-0112390 A 10/2011
KR 10-2012-0025555 A 3/2012
KR 10-1290440 B1 7/2013

* cited by examiner

*Primary Examiner* — Hieu T Vo
*Assistant Examiner* — Arnold Castro
(74) *Attorney, Agent, or Firm* — McDermott Will & Emery LLP

(57) ABSTRACT

An apparatus for resetting an engine brake to be able to exhibit a braking force by opening an exhaust valve at the close of a compression stroke of an engine to prevent combustion includes a housing configured to introduced with pressurized oil from the engine brake and to discharge the oil to the outside depending on an operation of a rocker arm of the engine brake, a check plate configured to be elastically supported within an inside of the housing to control oil introduced into the housing, a piston configured to be accommodated in the check plate and slid when the inside of the housing is filled with oil to discharge the oil, and a reset pin configured to be elevatably installed at one side of the housing to form a passage through which the oil is discharged from the housing to the outside.

9 Claims, 13 Drawing Sheets

APPARATUS FOR RESETTING AN ENGINE BRAKE USING DECOMPRESSING

CROSS-REFERENCE TO RELATED APPLICATIONS

This application claims priority to Korean Patent Application No. 10-2014-0175960, filed on Dec. 9, 2014 with the Korean Intellectual Property Office, which is incorporated herein by reference in its entirety.

TECHNICAL FIELD

The present disclosure relates to an engine brake for releasing a pressure at the close of a compression stroke, and more particularly, to an apparatus for resetting an engine brake using decompressing for resetting an oil pressure when the oil pressure inside the engine brake is increased, by discharging the pressurized oil to the outside to be an initial pressure.

BACKGROUND

A typical engine brake operates in a vehicle in such a manner that a shift ratio of a gear is adjusted downward. However, since a shift stage is adjusted downward, an excessive load is applied to each part of the engine, and thus the life of an engine may be shortened.

In one method for solving the above problem, an engine brake using compressing to forcibly open an exhaust valve at the close of a compression stroke of the engine to prevent a combustion stroke of the engine from being performed to maximize an effect of the engine brake is provided.

FIG. 1 is a graph illustrating a displacement of a valve lift at the time of using an engine brake using decompressing according to the related art.

The engine brake using decompressing according to the related art is configured to include a socket brake to be supplied with engine oil when the engine brake is operated. In this configuration, the engine brake using decompressing vertically moves a piston by the supplied engine oil to remove a gap between a valve and a rocker arm to forcibly open an exhaust valve at the close of a compression stroke.

The socket brake opens the exhaust valve at the close of the compression stroke to activate the brake on the vehicle, thereby maximizing the effect of the engine brake. However, when the engine oil is introduced into the socket brake once, since the engine oil is not discharged, the valve may be further opened by the oil pressure which is formed in the socket brake. Therefore, the valve contacts the piston at a portion illustrated by 'A' of FIG. 1 and performance may deteriorate.

To improve the problem, the engine brake using decompressing from a reset unit is provided at one side, but has a problem in that a reset starting pressure is high and a reset operation may be poor due to a non-uniform contact with a housing when the piston in the socket brake ascends and descends.

Recently, replacing a large engine by improving an output of a middle engine, (engine downsizing) has been applied, but the engine brake using decompressing may be not be sufficiently applied due to a size of the engine and may not often meet regulations about braking performance.

SUMMARY OF THE DISCLOSURE

An embodiment of the present disclosure is directed to an apparatus for resetting an engine brake using decompressing capable of lowering a reset starting pressure and improving an elevation function of a piston. This may be done at the time of a reset operation while resetting the engine brake using decompressing by operating a rocker arm to discharge oil so as to remove an oil pressure.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an embodiment of the present disclosure, an apparatus for resetting an engine brake to provide a braking force by opening an exhaust valve at the close of a compression stroke of an engine to prevent combustion may include: a housing configured to be introduced with pressurized oil from the engine brake and configured to discharge the oil to the outside depending on an operation of a rocker arm of the engine brake; a check plate configured to be elastically supported to an inside of the housing to control oil introduced into the housing; a piston configured to be accommodated in the check plate and slid when the inside of the housing is filled with oil to discharge the oil; and a reset pin configured to be elevatably installed at one side of the housing to form a passage through which the oil is discharged from the housing to the outside, wherein when a pressure of the engine brake is increased, the oil is introduced into the housing and then one end of the rocker arm operates the reset pin to discharge the oil so as to resetting the oil pressure.

The housing may be divided into a space which the piston is installed and a space in which the reset pin is installed.

The space in which the piston is installed may be provided with an inlet into which oil is introduced from the outside.

The space in which the reset pin is installed may be provided with an outlet through which the oil in the housing is discharged to the outside and the space in which the piston is installed and the space in which the reset pin is installed may communicate with each other through a communication port.

The inlet in the housing may be controlled by the check plate and a portion where the inlet is connected to an inner space of the housing may be formed to be inclined.

The portion where the inlet is connected to the inner space of the housing may be provided with a channel through which the oil flows.

The piston may be formed so that an upper diameter is smaller than a lower diameter.

A circumference of an upper end of the piston may be provided with protrusions at a predetermined interval, in which the protrusions support the circumference of the upper end of the piston to an inner side of the housing.

The communication port may be lower than the outlet.

The reset pin may be installed to penetrate through the housing and a reset spring may be installed between a snap ring installed at an upper end of the reset pin and the housing to elastically support the reset pin in an ascending direction.

The reset pin may be formed to have a constant diameter from the upper end to a middle portion, and be slenderly formed to have a diameter reduced from the middle portion to the lower end. Further, a diameter of the lower end may be larger than a portion where the diameter is constantly formed.

A slender portion at the reset pin may let the communication port communicate with the outlet when the reset pin descends and the lower end of the reset pin may be shut off so that the communication port does not communicate with the outlet when the reset pin ascends.

The reset pin may be operated by a reset plate which is installed at the end of the rocker arm.

DETAILED DESCRIPTION

Figure 1:
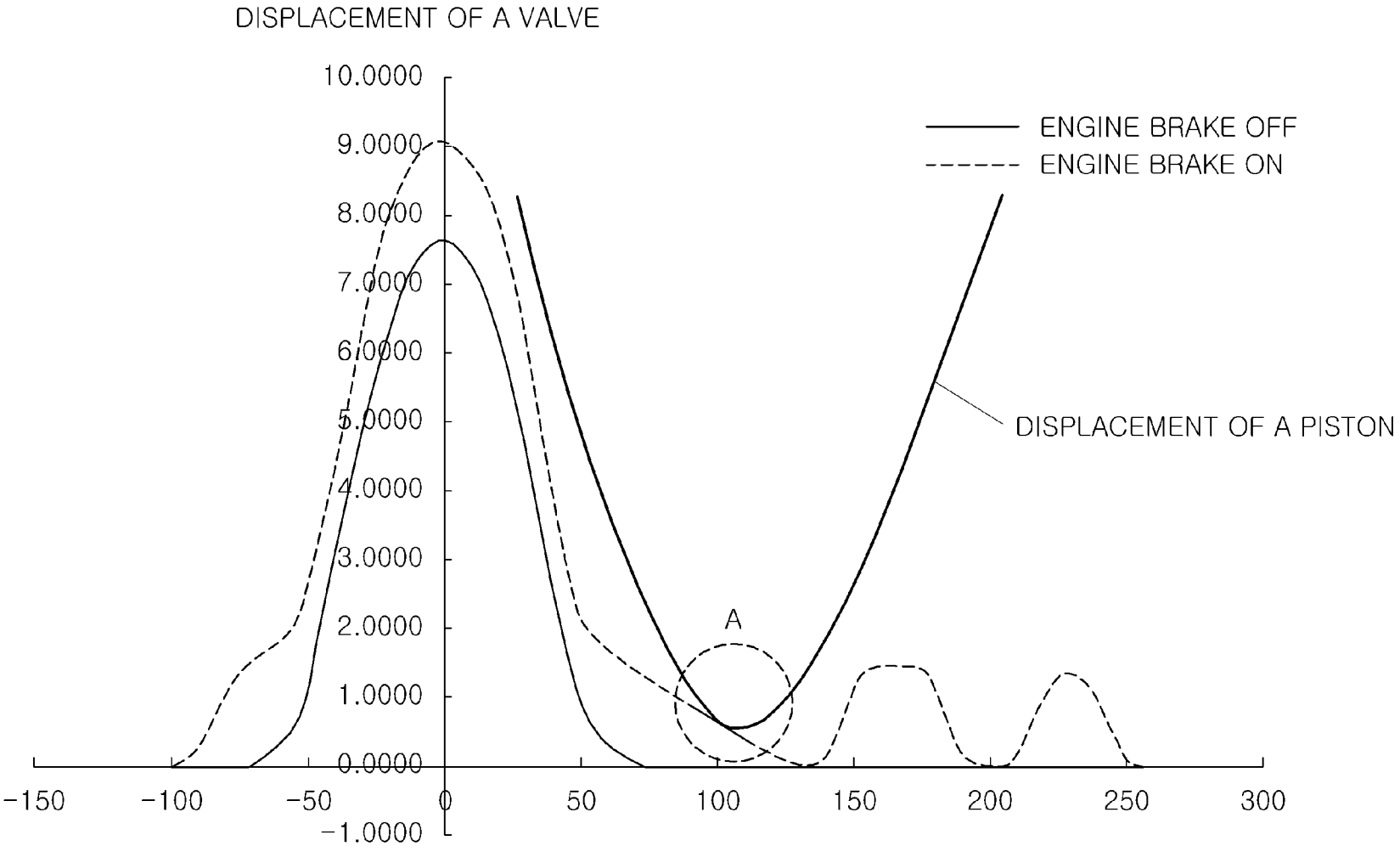
FIG. 1 is a graph illustrating a displacement of a valve at the time of using an engine brake using decompressing according to the related art.

Hereinafter, an apparatus for resetting an engine brake using decompressing according to exemplary embodiments of the present disclosure will be described with reference to the accompanying drawings.

According to an exemplary embodiment of the present disclosure, an apparatus for resetting an engine brake may include: a housing 31 configured to be introduced with pressurized oil from the engine brake 10 and discharge the oil to the outside depending on an operation of a rocker arm of the engine brake 10; a check plate 32 configured to be elastically supported to an inside of the housing 31 to control oil introduced into the housing 31; a piston 33 configured to be accommodated in the check plate 32 and slid when the inside of the housing 31 is filled with oil to discharge the oil; and a reset pin 36 configured to be elevatably installed at one side of the housing 31 to form a passage through which the oil is discharged from the housing 31 to the outside.

Figure 2:
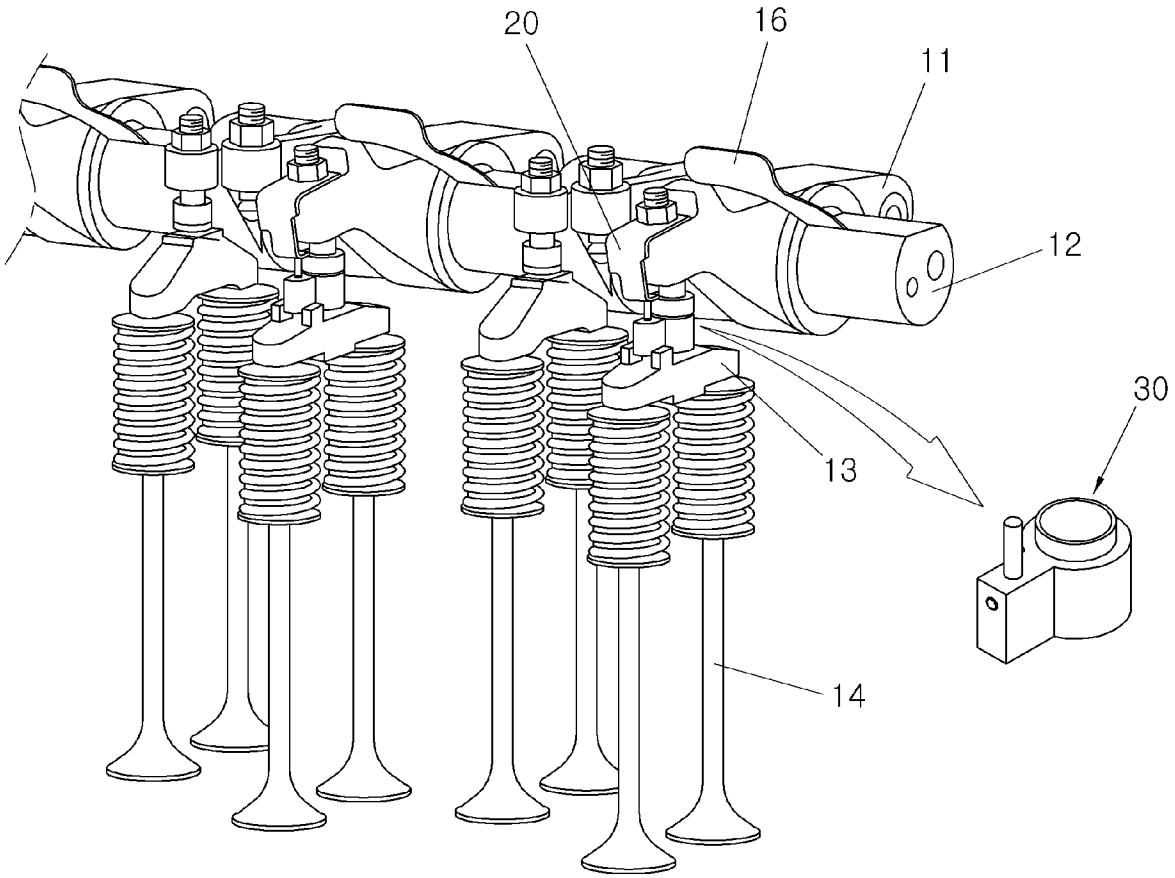
FIG. 2 is a perspective view of an engine brake using decompressing to which an apparatus for resetting an engine brake using decompressing according to an exemplary embodiment of the present disclosure is applied.

FIG. 2 illustrates the engine brake 10 using decompressing where an apparatus for resetting an engine brake using decompressing according to an exemplary embodiment of the present disclosure is applied.

The engine brake 10 using decompressing may include a rocker arm 11 which is rotatably installed at a rocker arm shaft 12, within a predetermined angle, and a valve bridge 13 positioned at one end of the rocker arm 11 and pressurizing a valve 14 to be opened. An oil line, to which high pressure oil is supplied, is connected to the valve bridge 13. In the present case, the engine brake 10 is operated while the valve bridge 13 descends by the oil supplied through the oil line.

Figure 3:
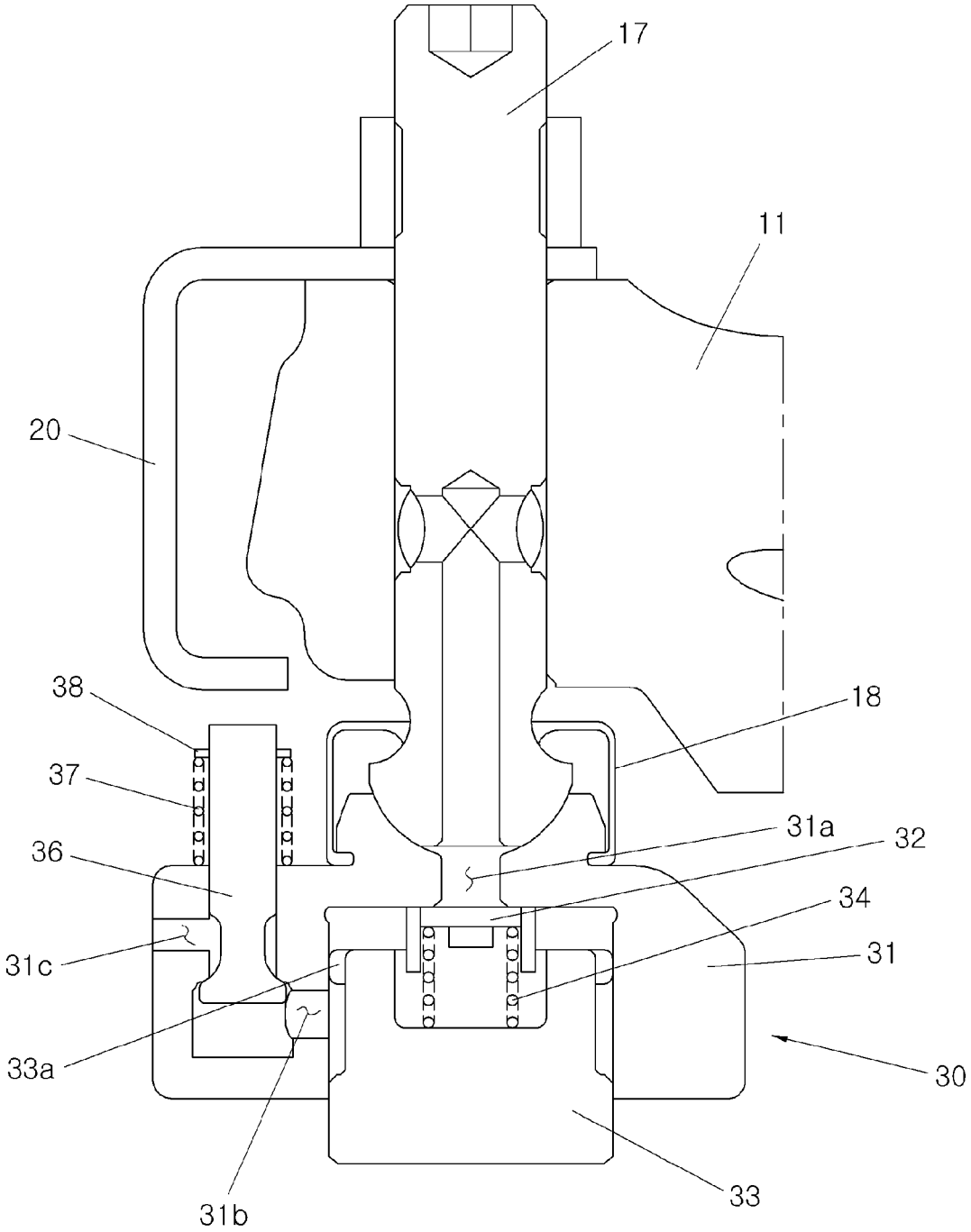
FIG. 3 is a cross-sectional view of an engine brake using decompressing to which the apparatus for resetting an engine brake using decompressing according to an exemplary embodiment of the present disclosure is applied.

As illustrated in FIG. 3, the apparatus 30 for resetting an engine brake using decompressing is positioned between one end of the rocker arm 11 and the valve bridge 13. A reset plate 20, which may operate the reset pin 36 of the resetting apparatus 30, is installed at one end of the rocker arm 11. Further, a lower end of a screw 17 and the apparatus 30 for resetting an engine brake using decompressing are constrained by a clip 18.

The apparatus 30 for resetting an engine brake using decompressing according to the exemplary embodiment of the present disclosure includes a housing 31 and the piston 33 may be elevatably installed in the housing 31. The check plate 32 may open and close an inlet 31*a* of the housing 31, and the reset pin 36 may be installed at one side of the housing 31.

Figure 4:
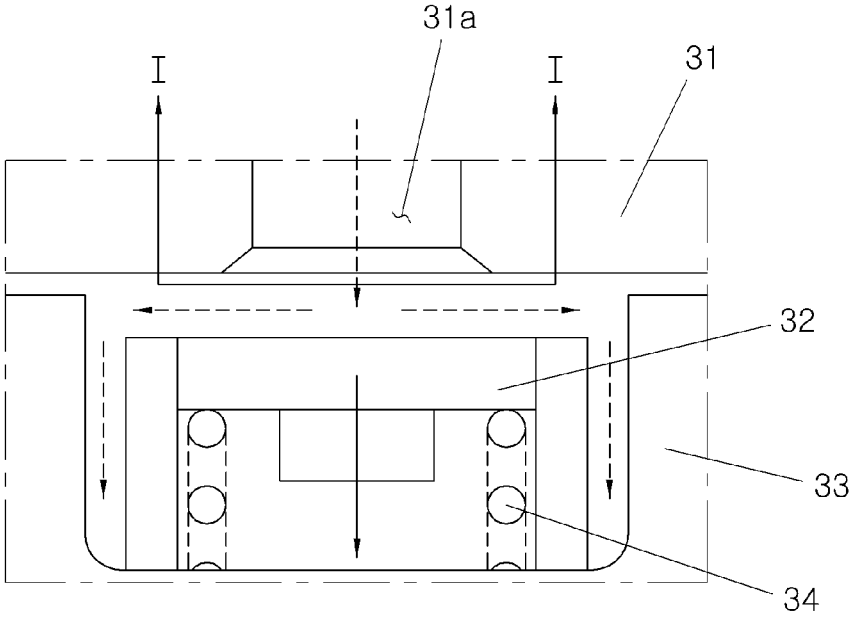
FIG. 4 is an enlarged cross-sectional view illustrating a portion where oil is introduced into a housing in FIG. 3.
Figure 5:
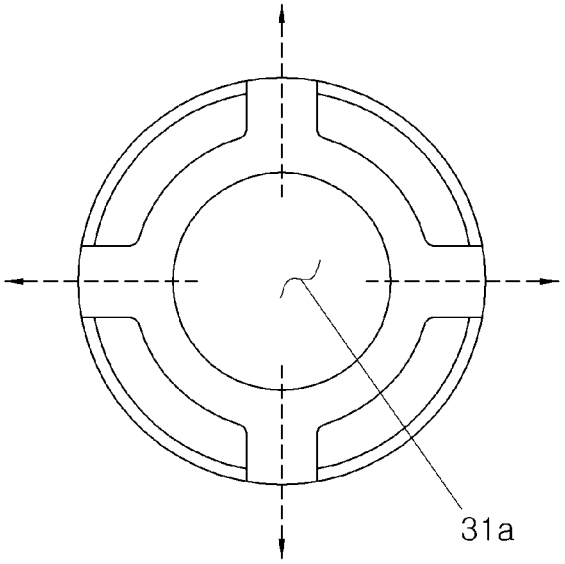
FIG. 5 is a diagram illustrating an inlet taken along the line I-I of FIG. 4.

The housing 31 has an inside provided with two spaces. One space is a space into which the pressurized oil is introduced, in which the piston 33 and the check plate 32 are accommodated in the space. The reset pin 36 is accommodated in the reset space. The two spaces are connected to each other by a communication port 31*b*. In the housing 31, a portion where the piston 33 is positioned is provided with an inlet 31*a*, into which oil is introduced. As illustrated in FIG. 4, a portion where an end of the inlet 31*a* is connected to, or, an inner space of the housing 31, is inclinedly formed and as illustrated in FIG. 5. A separate channel is formed therein, such that as illustrated by a dotted line in FIGS. 4 and 5, a large amount of flow rate of oil may flow within a short period of time, thereby rapidly implementing the rapid reset.

In the housing 31, a space in which the piston 33 exists is formed along the elevation direction of the piston 33, and includes a constant inner diameter.

Meanwhile, the reset space, that is, the space in which the reset pin 36 is installed, is provided with an outlet 31*c* which communicates with the outside. Here, the outlet 31*c* is formed to be higher than the communication port 31*b*. Further, in the space in which the reset pin 36 is installed, an inner diameter of a portion adjacent to the communication port 31*b* is formed to be larger than that of a portion adjacent to the outlet 31*c*. A portion into which the reset pin 36 is inserted has different diameters based on the end of the communication port 31*b*, which is to be sealed and locked to a portion where the diameter of the reset pin 36 is different.

Further, in the housing 31, the communication port 31*b* is positioned to be lower than the outlet 31*c*, and thus a flow of oil may be controlled between the communication port 31*b* and the outlet 31*c* by the elevation of the reset pin 36.

The check plate 32 closes the inlet 31*a* by being elastically supported. That is, when a force by the oil pressure applied through the inlet 31*a* is larger than the elastic force by the spring 34, the check plate 32 opens the inlet 31*a*. Otherwise, the check plate 32 closes the inlet 31*a*.

In the housing 31, the piston 33 is installed at a portion where the inlet 31*a* is formed. An inside of the upper portion of the piston 33 is provided with a space in which the check plate 32 may be elevated and has the check plate 32 accommodated therein. A circumference of the upper end of the piston 33 may close the inlet 31*a* and the outer diameter of the lower portion is generally formed to be larger than that of the diameter of the upper portion. This serves to rapidly discharge oil and lower the reset starting pressure, at which the reset starts by making the portion of the outer diameter communicate with the communication port 31*b* even though the piston 33 slightly descends.

Meanwhile, the upper end of the piston 33 is provided with a protrusion 33*a* which guides the upper end at the time of elevating the piston 33, and supports the circumference of the upper end of the piston 33 to an inner side wall of the housing 31. The protrusion 33*a* is not formed over the whole circumference of the upper end of the piston 33, but some thereof is formed at a predetermined interval and therefore may guide the elevation of the piston 33 and implement the flow of oil.

In the housing 31, the reset pin 36 is disposed in a space adjacent to the outlet 31*c*. The reset pin 36 has a constant diameter from the upper end to a middle portion, a reduced diameter under the middle portion and thus is formed to be slender, and a lower end of the reset pin 36 has an increased diameter, thus having a diameter larger than the portion having a constant diameter from the upper end to the middle portion and the largest diameter on the reset pin 36. The reason that some of the reset pin 36 is formed to be slender is to make the communication port 31*b* communicate with the outlet 31*c* at the time of descending of the reset pin 36. Further, the reason that the diameter of the lowest end is largest is to make the reset pin be locked to the portion where the diameter is changed between the communication port 31*b* and the outlet 31*c* in the housing 31 to prevent the communication port 31*b* and the outlet 31*c* from communicating with each other, thereby preventing the oil leakage.

The reset pin 36 is elastically supported in the direction in which the reset pin 36 ascends due to the reset spring 37, which is inserted between a snap ring 38 installed at the upper end protruding toward the housing 31 and the housing 31.

Meanwhile, an operation of the apparatus for resetting an engine brake using decompressing according to the exemplary embodiment of the present disclosure will be described with reference to FIGS. 6A to 6F.

Figure 6A:
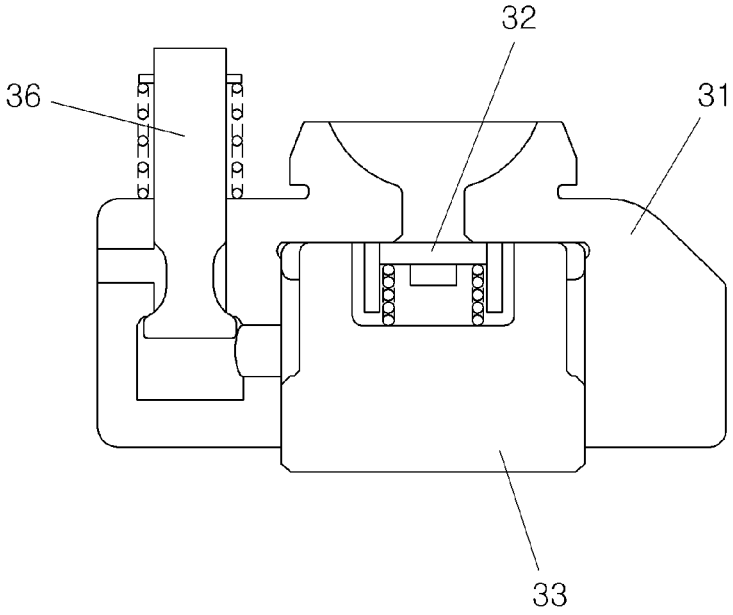
FIGS. 6A to 6F are cross-sectional views illustrating a reset process of an engine brake.

FIG. 6A illustrates an initial state. In the initial state, the check plate 32 closes the inlet 31*a* into which the oil is introduced, the piston 33 in the housing 31 is in a maximally ascending state, and the reset pin 36 maximally ascends due to the reset spring 37 to make the inlet 31*a* enter a closed state to prevent the communication portion 31*b* and the outlet 31*c* from communicating with each other.

Figure 6B:
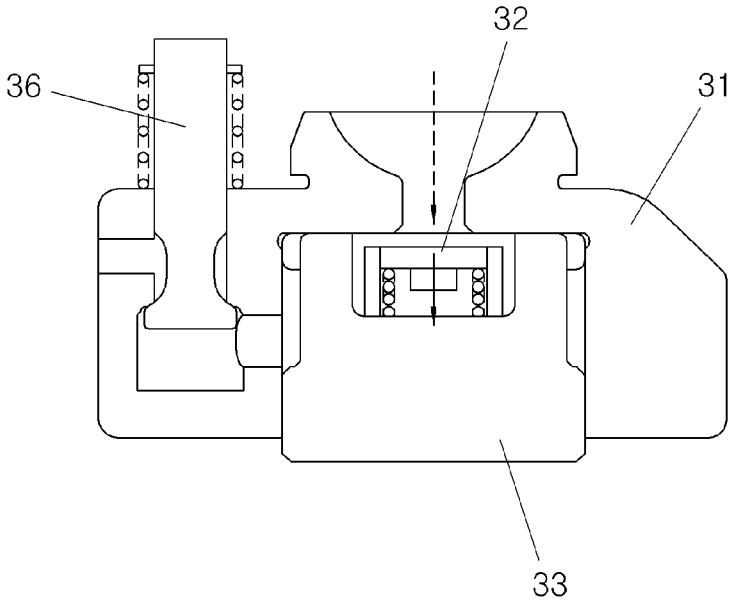

When the pressurized oil is supplied in the initial state, as illustrated in FIG. 6B, the inlet 31*a* is opened while the check plate 32 descends due to the oil pressure and the oil is introduced into the housing 31. In this case, as described above, the portion where the inlet 31*a* is connected to the housing 31 is inclinedly formed and includes the channel, such that the pressurized oil is rapidly introduced into the housing 31.

Figure 6C:
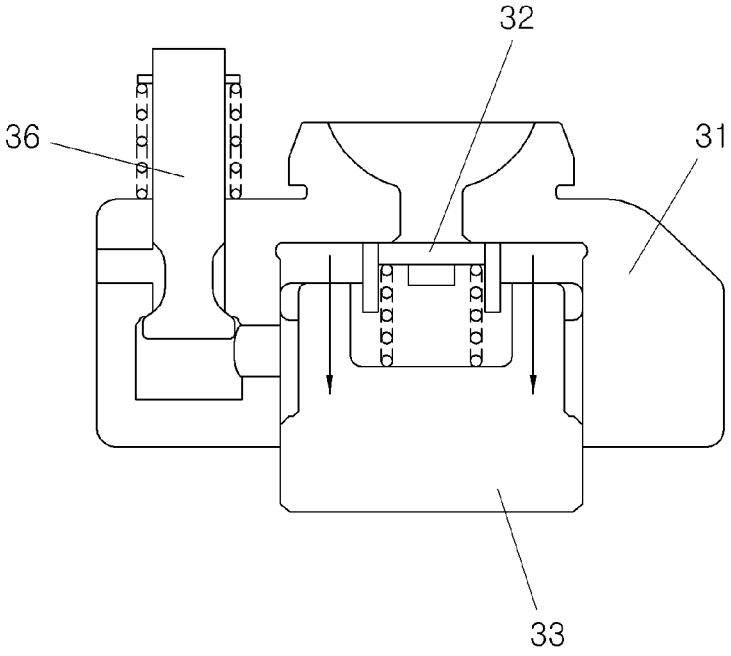
Figure 8A:
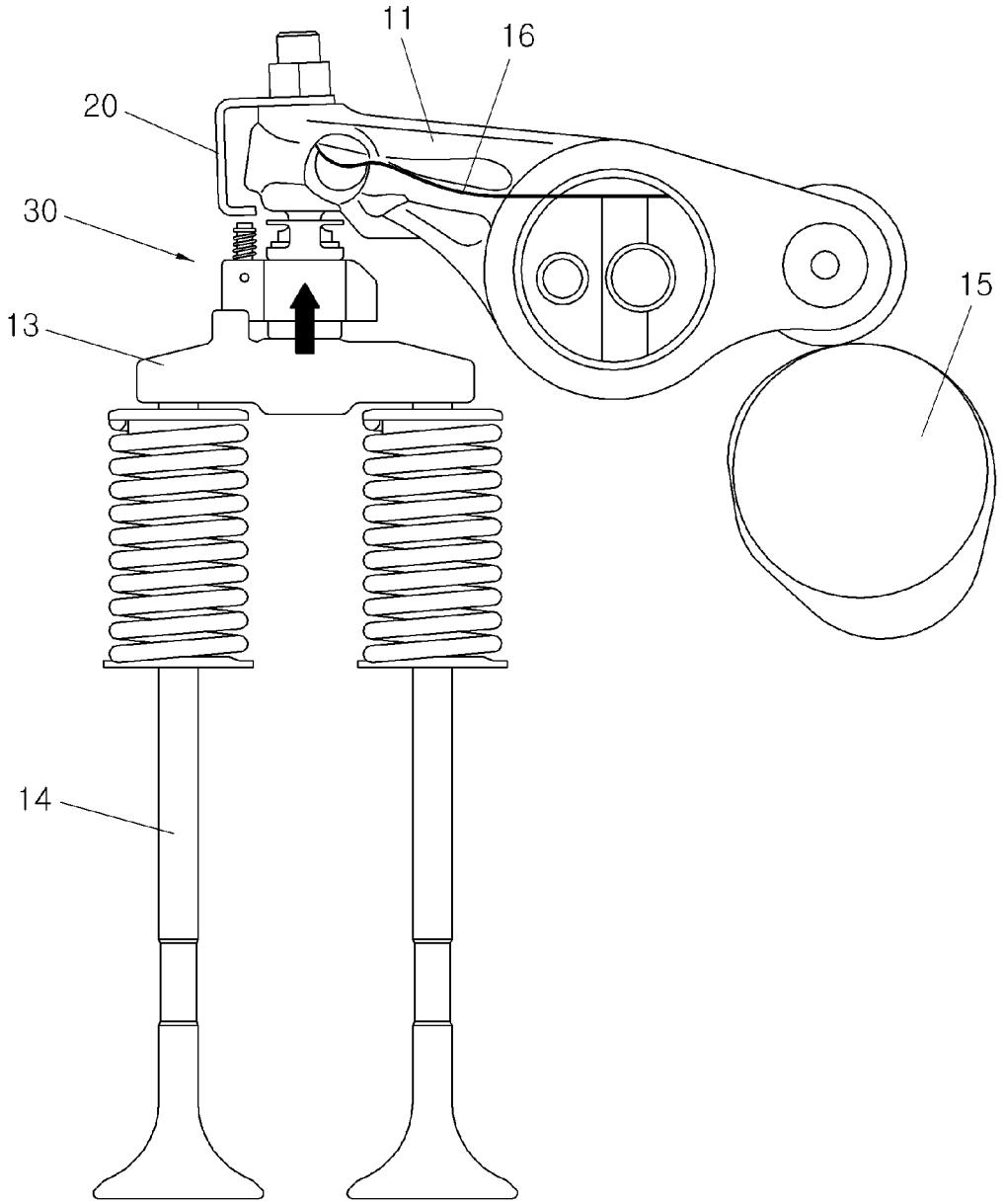
FIGS. 8A and 8B are front and enlarged views illustrating a state in which the engine brake is operated.
Figure 8B:
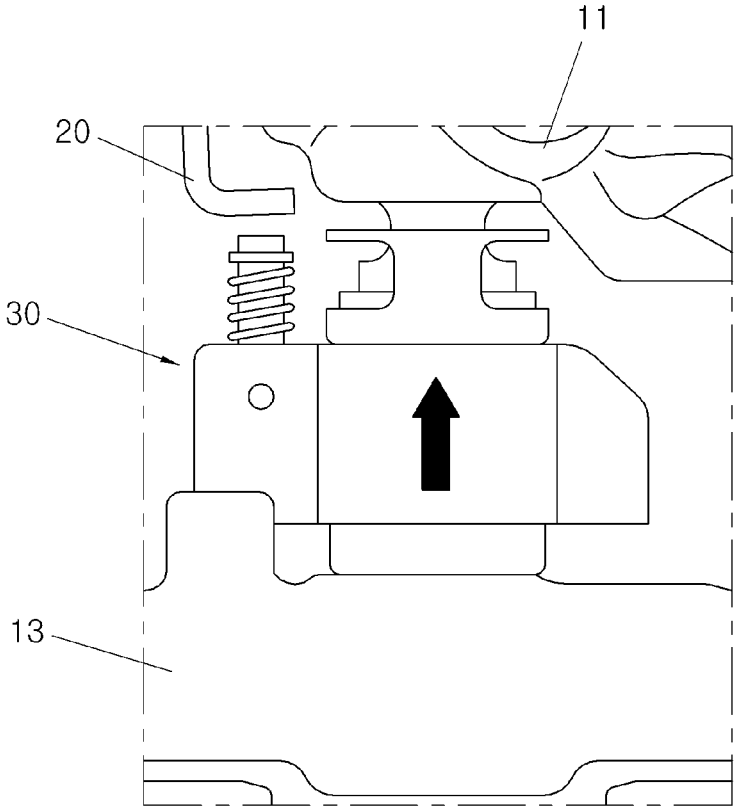

Further, as illustrated in FIG. 6C, when the oil is introduced into the housing 31, the piston 33 descends while the pressure in the housing 31 is increased and a gap between a roller and a cam 15, installed at the other end of the rocker arm 11, is offset while the housing 31 relatively ascends (see FIGS. 8A and 8B).

Figure 6D:
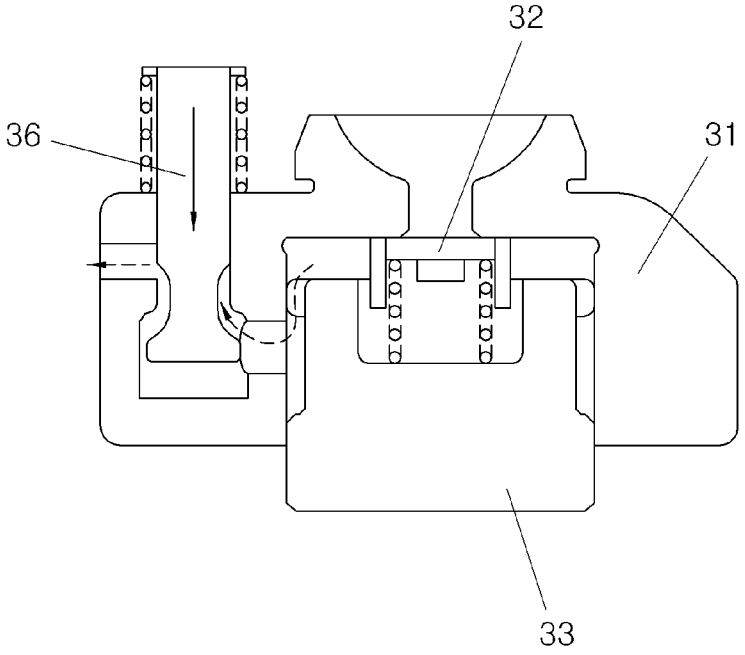

As the engine rotates, the rocker arm 11 is operated while the roller rotates. As a result, the reset plate 20 installed at the end of the rocker arm 11 presses the reset pin 36 and the reset pin 36 descends as illustrated in FIG. 6D. Since the communication port 31*b* communicates with the outlet 31*c*, the pressurized oil in the housing 31 is discharged through the communication port 31*b* and the outlet 31*c*.

Figure 6E:
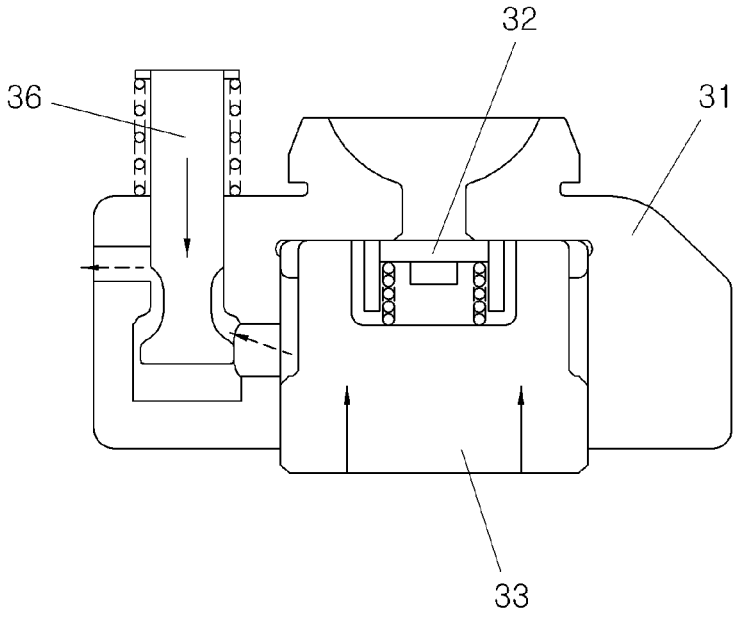
Figure 6F:
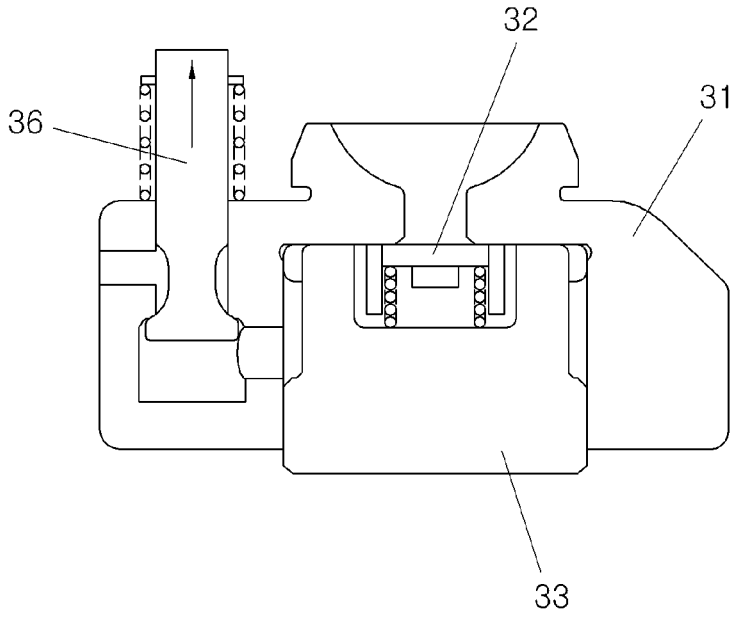

When the oil is discharged continuously, the pressure in the housing 31 is removed and thus the piston 33 ascends (see FIG. 6E). When the oil in the housing 31 is completely discharged, the lower end of the reset pin 36 closes between the communication port 31*b* and the outlet 31*c* while the reset pin 36 ascends by the elastic force of the reset spring 37 (see FIG. 6F).

As described above, when the oil pressure in the engine brake is increased, the process of FIGS. 6A to 6F is repeated while the pressurized oil is supplied to the inside of the housing 31, thereby maintaining the oil pressure at a constant level.

Figure 7A:
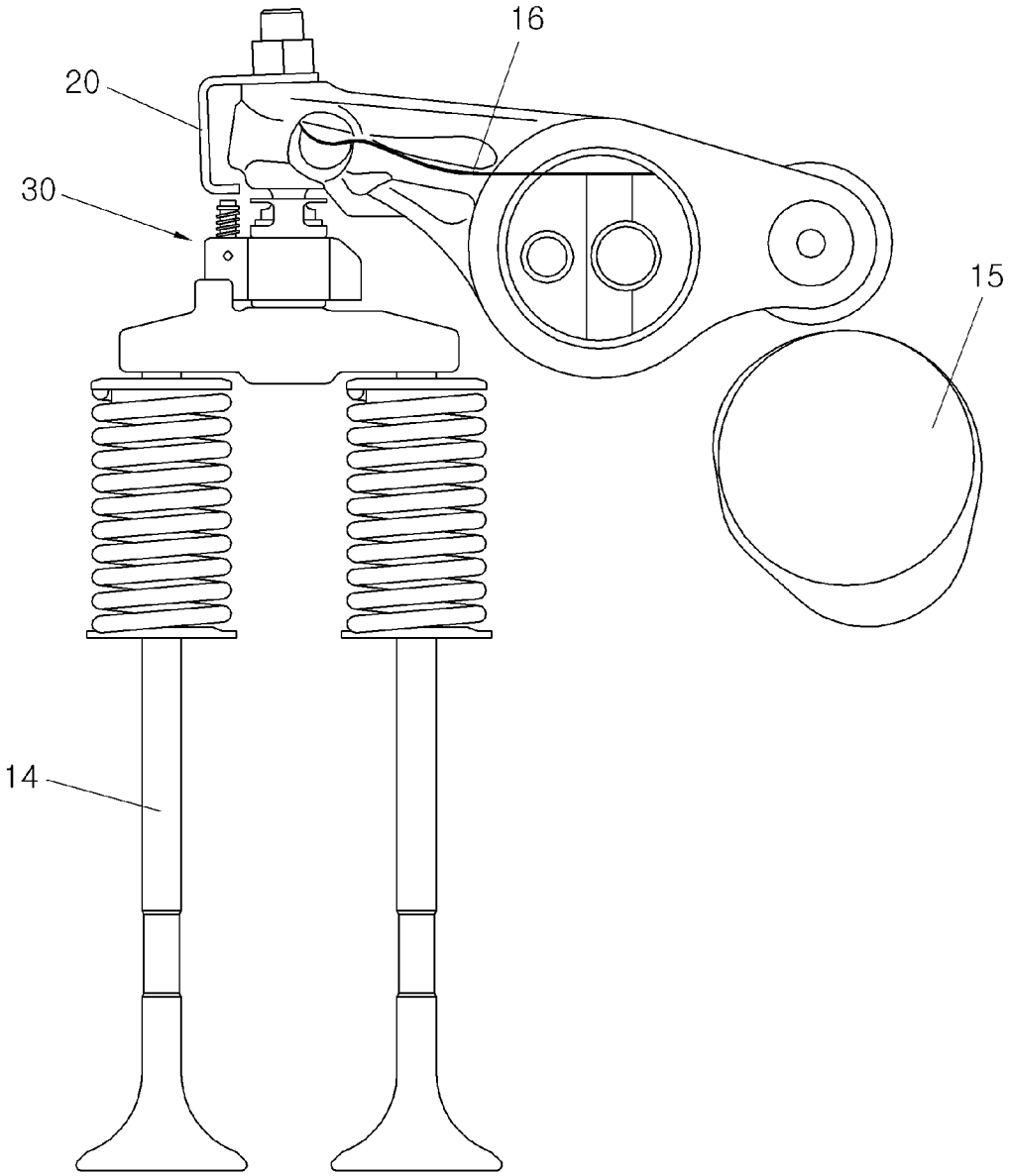
FIGS. 7A and 7B are front and enlarged views illustrating a state in which the engine brake is not operated.
Figure 7B:
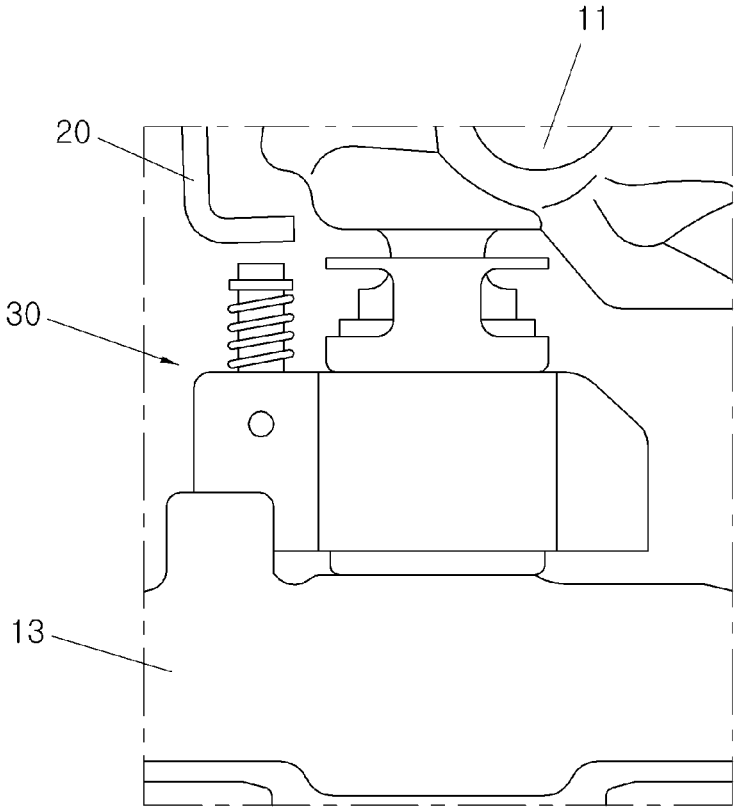

FIGS. 7A and 7B illustrate the state in which the engine brake 10 is not operated and FIGS. 8A and 8B illustrate the state in which the engine brake 10 is operated.

When the oil to operate the engine brake 10 is not supplied, the gap is present between the roller and the cam 15, which are installed at the other end of the rocker arm 11 to prevent a portion protruding from a base of the cam 15 from being contacted to the roller, such that the engine brake 10 is not operated.

However, when the oil to operate the engine brake 10 is supplied, the apparatus 30 for resetting an engine brake, using decompressing, lifts the rocker arm 11 to make the roller and the cam 15 contact each other at all times. Therefore, the rocker arm 11 is operated by the portion protruding from the base source of the cam 15, such that the engine brake 10 is operated.

Figure 9:
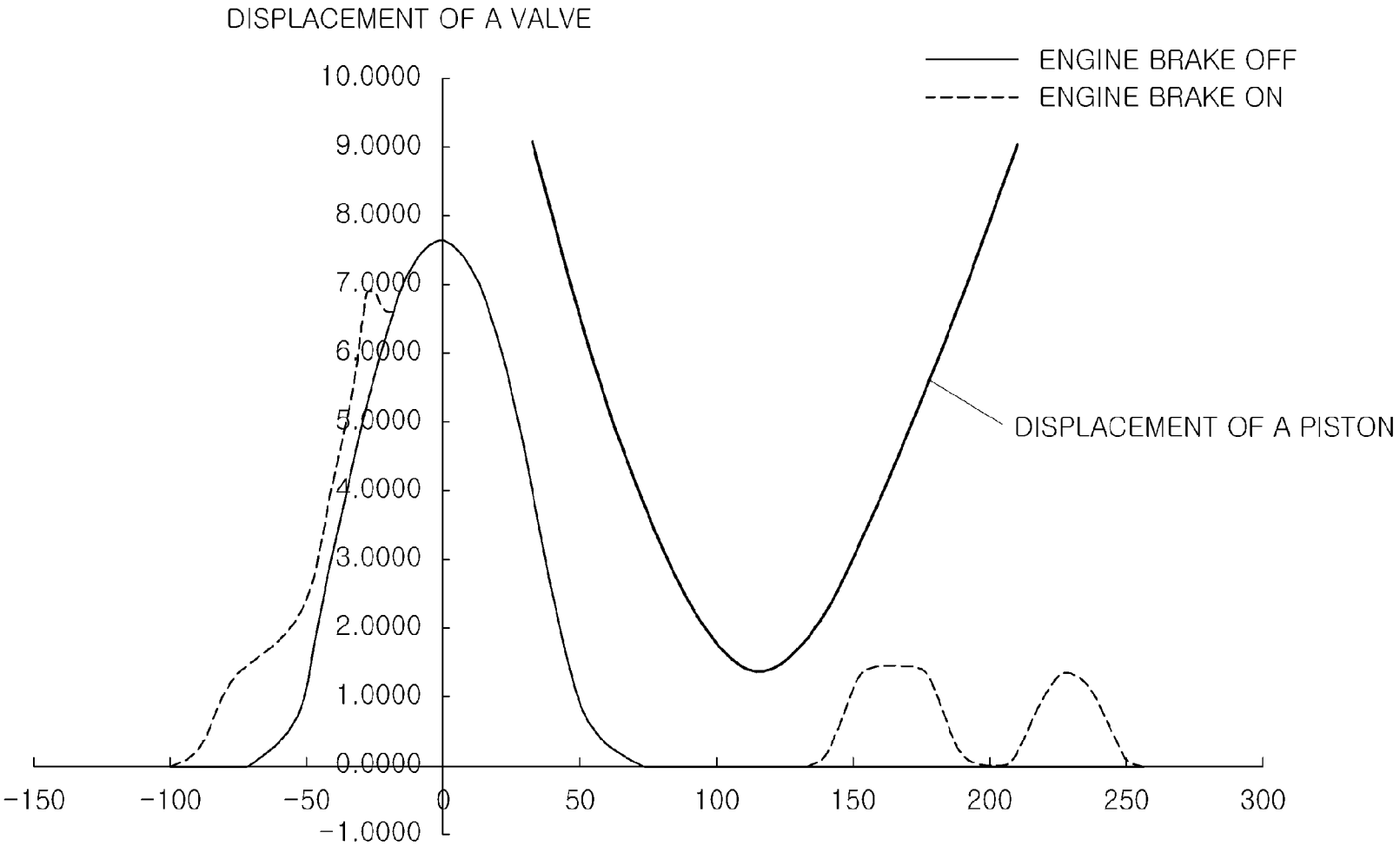
FIG. 9 is a graph illustrating a displacement of a valve in an engine brake using decompressing to which an apparatus for resetting an engine brake using decompressing according to an exemplary embodiment of the present disclosure is applied.

The apparatus 30 for resetting an engine brake using decompressing according to the exemplary embodiment of the present disclosure is applied to the inside of the engine brake 10 to prevent the pressure of oil from increasing, thereby preventing the contact of the valve and the piston, as in the related art, and preventing the operations of the valve and the piston from interfering with each other as illustrated in FIG. 9.

According to the apparatus for resetting an engine brake using decompressing according to the exemplary embodiments of the present disclosure configured as described above, it is possible to rapidly reset the engine brake by increasing the area of oil supplied into the housing and opening the communication port at the initial time of the descending of the piston.

Further, the oil is discharged at the initial time of the reset process and therefore the reset starting pressure is reduced.

Further, the portion where the reset pin is positioned at the communication port and the outlet is formed to be slender, and thus the oil may flow at the initial time of the operation. The lower end of the reset pin contacts the housing to improve sealing functionality.

Further, when the piston is elevated within the housing, the upper end and the lower end of the piston are supported by the inner wall of the housing and thus the piston may be smoothly elevated.

The foregoing exemplary embodiments are only examples to allow a person having ordinary skill in the art to which the present disclosure pertains (hereinafter, referred to as "those skilled in the art") to easily practice the present disclosure. Accordingly, the present disclosure is not limited to the foregoing exemplary embodiments and the accompanying drawings, and therefore, a scope of the present disclosure is not limited to the foregoing exemplary embodiments. Accordingly, it will be apparent to those skilled in the art that substitutions, modifications and variations can be made without departing from the spirit and scope of the disclosure as defined by the appended claims and can also belong to the scope of the present disclosure.

What is claimed is:

1. An apparatus for resetting an engine brake to be able to exhibit a braking force by opening an exhaust valve at the close of a compression stroke of an engine to prevent combustion, comprising:

a housing configured to be introduced with pressurized oil from the engine brake and to discharge the oil to the outside depending on an operation of a rocker arm of the engine brake;

a check plate configured to be elastically supported within an inside of the housing to control oil introduced into the housing;

a piston configured to be accommodated in the check plate and slide when the inside of the housing is filled with oil to discharge the oil; and a reset pin configured to be elevatably installed at one side of the housing to form a passage through which the oil is discharged from the housing to the outside, wherein when a pressure of the engine brake is increased, the oil is introduced into the housing and one end of the rocker arm operates the reset pin to discharge the oil so as to reset the oil pressure, wherein the piston is formed so that an upper diameter is smaller than a lower diameter, and wherein a circumference of an upper end of the piston is provided with protrusions at a predetermined interval, the protrusions supporting the circumference of the upper end of the piston to an inner side of the housing.

2. The apparatus of claim 1, wherein the housing is divided into a space in which the piston is installed and a space in which the reset pin is installed, the space in which the piston is installed is provided with an inlet into which oil is introduced from the outside, the space in which the reset pin is installed is provided with an outlet through which the oil in the housing is discharged to the outside, and the space in which the piston is installed and the space in which the reset pin is installed communicate with each other through a communication port.

3. The apparatus of claim 2, wherein the inlet in the housing is controlled by the check plate, and a portion where the inlet is connected to an inner space of the housing is formed to be inclined.

4. The apparatus of claim 3, wherein the portion where the inlet is connected to the inner space of the housing is provided with a channel through which the oil flows.

5. The apparatus of claim 1, wherein the reset pin is operated by a reset plate which is installed at the end of the rocker arm.

6. The apparatus of claim 1, wherein the reset pin is installed to penetrate through the housing and a reset spring is installed between a snap ring installed at an upper end of the reset pin and the housing to elastically support the reset pin in an ascending direction.

7. The apparatus of claim 2, wherein the communication port is formed to be lower than the outlet.

8. The apparatus of claim 2, wherein the reset pin is formed to have a constant diameter from the upper end to a middle portion, slenderly formed to have a diameter reduced from the middle portion to the lower end, and formed so that a diameter of the lower end is larger than a portion where the diameter is constantly formed.

9. The apparatus of claim 8, wherein a slender portion of the reset pin allows the communication port to communicate with the outlet when the reset pin descends, and the lower end of the reset pin is shut off so that the communication port does not communicate with the outlet when the reset pin ascends.

* * * * *